US010941620B2

(12) United States Patent
Hanton et al.

(10) Patent No.: US 10,941,620 B2
(45) Date of Patent: Mar. 9, 2021

(54) DOWNHOLE SWIVEL SUB AND METHOD FOR RELEASING A STUCK OBJECT IN A WELLBORE

(71) Applicant: Tercel IP Limited, Road Town (VG)

(72) Inventors: John Hanton, Dyce (GB); Jeffrey B. Lasater, Houston, TX (US)

(73) Assignee: TERCEL IP LIMITED, Road Town (VG)

( * ) Notice: Subject to any disclaimer, the term of this patent is extended or adjusted under 35 U.S.C. 154(b) by 379 days.

(21) Appl. No.: 15/306,548

(22) PCT Filed: Mar. 31, 2015

(86) PCT No.: PCT/EP2015/057040
§ 371 (c)(1),
(2) Date: Oct. 25, 2016

(87) PCT Pub. No.: WO2015/161993
PCT Pub. Date: Oct. 29, 2015

(65) Prior Publication Data

US 2017/0044843 A1 Feb. 16, 2017

(30) Foreign Application Priority Data

Apr. 25, 2014 (EP) ..... 14166108
Jun. 10, 2014 (EP) ..... 14171836

(51) Int. Cl.
*E21B 17/05* (2006.01)
*E21B 31/00* (2006.01)
*E21B 31/107* (2006.01)

(52) U.S. Cl.
CPC ..... *E21B 17/05* (2013.01); *E21B 31/005* (2013.01); *E21B 31/107* (2013.01)

(58) Field of Classification Search
CPC ..... E21B 31/005; E21B 31/107; E21B 43/10
See application file for complete search history.

(56) References Cited

U.S. PATENT DOCUMENTS 6,082,457 A * 7/2000 Best ..... E21B 17/05 166/178
6,244,345 B1 * 6/2001 Helms ..... E21B 7/067 166/301

(Continued)

OTHER PUBLICATIONS

International Search Report as issued in International Patent Application No. PCT/EP2015/057040, dated Jan. 26, 2016.

(Continued)

*Primary Examiner* — Robert E Fuller
*Assistant Examiner* — Lamia Quaim
(74) *Attorney, Agent, or Firm* — Pillsbury Winthrop Shaw Pittman LLP

(57) ABSTRACT

In certain embodiments, a downhole swivel sub includes a first swivel part configured to connect to a first section of a workstring, and a second swivel part configured to connect to a second section of the workstring. The second swivel part is rotatable relative to the first swivel part. The downhole swivel sub also includes a locking sleeve rotationally coupled with the first swivel part and movable axially between a locking position wherein the first swivel part and the second swivel part are rotationally coupled and an unlocking position wherein the first swivel part is rotatable relative to the second swivel part. The locking sleeve includes at least two first rows of teeth disposed at a same radial position and separated axially on the locking sleeve. The at least two first rows of teeth are configured to engage and disengage with at least two second rows of teeth located on the second swivel part.

19 Claims, 5 Drawing Sheets

(56) References Cited

U.S. PATENT DOCUMENTS

| | | | | |
|---|---|---|---|---|
| 6,543,556 | B1 * | 4/2003 | Anderson | E21B 17/073 166/178 |
| 2003/0127857 | A1 | 7/2003 | Boyd et al. | |
| 2004/0094309 | A1 | 5/2004 | Maguire | |
| 2012/0234559 | A1 | 9/2012 | Howlett et al. | |
| 2014/0352944 | A1 * | 12/2014 | Devarajan | E21B 23/02 166/123 |

OTHER PUBLICATIONS

Examination Report as issued in United Kingdom Application No. GB1617582.0, dated Apr. 24, 2020.
Examination Report as issued in UK Patent Application No. GB1617582.0, dated Aug. 11, 2020.

* cited by examiner

DOWNHOLE SWIVEL SUB AND METHOD FOR RELEASING A STUCK OBJECT IN A WELLBORE

CROSS REFERENCE TO RELATED APPLICATIONS

This application claims the benefit of and priority to International Application No. PCT/EP2015/057040, filed on Mar. 31, 2015, which claims the benefit of and priority to European Patent Application No. 14166108.2, filed Apr. 25, 2014, and the benefit of and priority to European Patent Application No. 14171836.1, filed Jun. 10, 2014, all of which are hereby incorporated by reference in their entireties for all purposes.

TECHNICAL FIELD

The present invention is related to a downhole swivel sub suitable for connection in a workstring between an upper section hung out from the wellbore's surface and a bottom section in order to mitigate the drag by allowing the upper section of the workstring to rotate, the bottom section including a downhole element such as a jar, a vibration tool, a bottom hole assembly, a liner, a screen, a whipstock, a multilateral completion or any device which is not desirable or not possible to rotate into a wellbore. According to a second aspect, the present invention is related to a method of operation in a wellbore using said swivel sub.

STATE OF THE ART

Drilling of a well for exploration or exploitation of an oilfield is performed by running a drillstring having a first tail end hung up and rotated at the surface of the well, and a front end comprising a bottom hole assembly run into the wellbore. For drilling applications, the bottom hole assembly comprises a drill bit for drilling a borehole, and the drillstring comprises a bore extending from the tail end to the drill bit, in which is injected a drilling fluid from the top of well, allowing the evacuation of cuttings while drilling and providing cooling of the drill bit. Rotation of the drillstring allows a better evacuation of the drilling mud and cuttings. In function of the drilling method used, the bottom hole assembly generally comprises other devices such as stabilizers, mud motor, rotary steering systems, reaming tools, under reamers, or drilling collars. In some cases, rotation of the drill bit is performed thanks to a mud motor located near the drill bit.

Directional drilling is a process in which the orientation of the well may be deviated once or several times. Introduction of the rotary steerable systems (RSS) technology has developed the use of directional drilling. Directional drilling has allowed for example to skirt some zones of difficult-to-drill formations, to have access to some reservoirs inaccessible vertically, such as reservoirs located under a town or a lake or groundwater.

Advanced directional drilling technologies are able to drill deep wellbores oriented horizontally and reaching distances of more than 5 km. Such a technique is known under the name "Extended reach drilling" (ERD). Up to now, the longest ERD well reached a measured total depth of 12376 meters.

In some cases, wherein a difficult-to-drill formation has to be circumvented (or skirted), the wellbore may comprise some horizontal sections and more than one deviation from the top of the wellbore to the bottom of the wellbore. While drilling such a wellbore, some parts of the drill string may become stuck in the borehole, for example in case of collapsing of some parts of the borehole. Also, disconnection of one of the drill pipes of the drillstring or failure of a drill pipe can occur. In some embodiments of downhole assemblies, the drillstring comprises disconnection means that can be activated for allowing disconnection of some sections of the drillstring, for example for disconnecting a free section of the drillstring from a stuck section of the drillstring located downwards the free section.

The stuck portion of the drillstring which is lost in the wellbore or disconnected from the drillstring is often called a "fish". The drilling operator may choose to remove the free section of the drillstring and to leave the fish in the wellbore, then to insert a new drillstring that will circumvent the fish. Alternatively the drilling operator removes the free section of the drillstring, and then he can try to release the fish from the wellbore by using a fishing assembly. A fishing assembly generally comprises a fishing tool at the front end of a string, and usually a jar located upstream the fishing tool, generally nearby the fishing tool. The fishing tool comprises a means for grabbing the stuck object. A jar is used for increasing the effect of a tensile or compressive force applied from the top of the string to free the object from the wellbore when the object is grabbed by said means for retrieving the object. The fishing assembly is moved down until the fishing tool reaches the object stuck in the wellbore. Once the object is grabbed by the fishing tool, the drilling operator applies a tensile or compressive force from the top of the wellbore for pulling or pushing the stuck objet, said longitudinal force activating the jar that provides a sudden variation of force on the stuck object that helps to attempt the releasing of the stuck object. The jar generally comprises two telescoping parts and a mechanism that upon applying a tensile or compressive force to the workstring, first provides a hard resistance against upward or downward movement of the workstring, and thereafter suddenly provides a low resistance against such movement until the two telescoping parts collide against each other, providing an impact on the workstring that helps to release the stuck portion of the drillstring.

In some other embodiments of downhole assemblies, the drillstring comprises a drilling jar. A drilling jar is a jar included in a drillstring. When the bottom assembly of the drillstring is stuck in the wellbore, a tensile or compressive force is applied from the surface of the well on the drillstring in order to try to free the stuck section of the drillstring.

Alternatively, a vibration tool such as disclosed in the U.S. Pat. No. 8,439,133 can be used to generate a pulsing action which is transmitted to a drill bit to avoid the drill bit becoming stuck or to free a stuck drill bit.

If the stuck section of the drillstring is at a distance of a few kilometers from the surface of the well, the tensile force required to be applied on the drillstring for moving up the drillstring and firing the jar is elevated. If a vibration tool is used for freeing the stuck section of the string, it is suitable to apply a tensile force to increase the chances to free the stuck section. However, the friction forces between the drillstring and the wall of the wellbore, more particularly in a highly deviated wellbore, makes it almost impossible to fire the jar or to apply the suitable force which combined with the vibration provided with the vibration tool would allow to free the stuck section of the string.

For highly deviated wellbores, or even for moderately deviated wellbores, retrieving of stuck objects into the wellbore is challenging.

Document U.S. Pat. No. 6,082,457 discloses a method of operating a drill string. The drill string comprises a drilling tool, a drilling jar, and a swivel sub located between an upper section of the drillstring and a lower section of the drillstring. The overall concept is a pressure activated clutch, whereby a ball is dropped and seats within the tool, providing an increase of internal pressure which disengages a clutch. The clutch rotationally ties the upper and lower ends of the tool together. So, once disengaged the upper and lower ends of the tool are free to rotate relatively. The swivel sub can be selectively locked or unlocked such that when the swivel sub is locked and when the upper section of the drillstring is rotated, the swivel sub transfers the rotation of the upper drillstring to the lower drillstring. When the swivel sub is unlocked, the upper drillstring can be rotated relative to the lower drillstring. When a section of the drillstring is stuck in the borehole, the swivel sub is unlocked and a tensile or compressive force is applied on the upper drillstring while rotating the upper drillstring. Rotation of the drillstring reduces the friction forces between the drillstring and the walls of the borehole that allows the tensile or compressive force to fire the jar. Once the clutch moves to a disengaged position, a side port is opened, thus allowing flow to the annular space around the tool. The problem is that when this occurs, pressure will immediately be equalized, thus allowing the clutch to reengage. Also, this clutch is represented as a castellated axially engaged tooth. In this configuration the shear on the tooth is very small, has a high stress concentration, and therefore such an embodiment wouldn't be strong enough to take the full torsional load of the drillstring during nominal operations. When the stuck portion of the drillstring is located at kilometers from the surface of the wellbore, the tensile force to apply on the drill string from the well surface to pull kilometers of drillstring pipes for firing the jar or the compressive force to apply on the drill string from the well surface to push kilometers of drillstring pipes for firing the jar in an attempt to release the stuck portion of the drillstring is very elevated. The firing of a jar requires the application of a tensile or compressive load in a range generally comprised between 10,000 lb and 180,000 lb depending on the type of the jar. The swivel sub must be able to allow the rotation of the upper part of the drillstring upon application of such a high load. Even though a swivel sub is disclosed in the document U.S. Pat. No. 6,082,457, that swivel sub is described as a concept only and no sufficient teaching is provided for the realization of a swivel sub able to support the loads required for firing a jar and that would be susceptible to be used in the method described in the document U.S. Pat. No. 6,082,457.

There is a need for a swivel sub that can be used in combination with a jar for releasing a portion of a drillstring stuck into a wellbore. Particularly, this swivel sub should be robust enough to support a load for firing a jar to release a portion of a drillstring which is stuck in a deep area of an "extended reach drilled" wellbore.

There is a further need for a swivel sub that can be used in combination with a vibration tool for releasing a section of a workstring stuck into a deep area of an extended reach drilled wellbore.

There is a further need for a swivel sub which can be used in a workstring for running a downhole element such as a liner, a screen, a whipstock or any other object that is not desirable to rotate into a wellbore, the swivel sub which should be able to selectively transmit sufficient torque to the downhole element for orient it or for attempting to unstuck it.

SUMMARY OF THE INVENTION

According to a first aspect, the present invention relates to a downhole swivel sub destined to be included between two sections of a workstring, said swivel sub having a bore extending there through and comprising:

- a first swivel part provided with a connection for a first section of the workstring;
- a second swivel part provided with a connection for a second section of the workstring, said second swivel part being rotatable relative to the said first swivel part;
- a locking sleeve rotationally coupled with the said first swivel part and movable axially between a locking position wherein the said first swivel part and the said second swivel part are rotationally coupled and an unlocking position wherein the said first swivel part is able to rotate relative to the said second swivel part;
- characterized in that the said locking sleeve comprises at least two first rows of teeth, disposed at the same radial position, separated axially on the said locking sleeve and arranged such as:
- to engage with at least two second rows of teeth located on the said second swivel part when the said locking sleeve is in the locking position and;
- to disengage from the said second rows of teeth of the said second swivel part when the said locking sleeve is in the unlocking position.

This feature allows a much greater shear area of engagement and thus spreads the shear load over a much larger area.

According to an embodiment, the said locking sleeve comprises a coupling subsection and the said first swivel part comprises a matching coupling subsection such that the locking sleeve is able to move axially along the said coupling subsection of the said first swivel part. Preferably, the coupling subsection of the first swivel part is longer than the coupling subsection of the locking sleeve. According to an embodiment, the coupling subsections of the locking sleeve and of the first swivel part have matching polygonal cross-sections.

According to an embodiment, a section of the said first swivel part is inserted into a section of the said second swivel part, the said first rows of teeth of the said locking sleeve are provided on the external surface of the locking sleeve and the said second rows of teeth of the said second swivel part are provided on the inner surface of the said second swivel part.

According to another embodiment, a section of the said first swivel part is inserted into a section of the said second swivel part, the said first swivel part comprising a shoulder and the said second swivel part comprising two abutments on either side of the said shoulder, or inversely, the said second swivel part comprising a shoulder and the said first swivel part comprising two abutments on either side of the said shoulder, a set of tensile bearings being provided between the said shoulder and a first abutment situated upwards the said shoulder, and a set of compression bearings being provided between the said shoulder and a second abutment situated downwards the said shoulder.

In the latter embodiment, the said compression bearings or the said tensile bearings or both compression bearings and tensile bearings may be maintained on their respective abutments by a high preload compression spring and at least one secondary abutment facing a portion of the said shoulder may be located on the swivel part comprising the said first and second abutments, the secondary abutment(s) being located at a distance from the said shoulder inferior to the width of one of the said bearings.

According to an embodiment, the said second swivel part forms a chamber comprising the said locking sleeve, said chamber being sealed to the outside of the swivel sub.

According to another embodiment, the said locking sleeve lies on a J-slot index mechanism and a spring maintained by a shoulder inside said second swivel part.

According to an embodiment, a section of the said first swivel part is inserted into a section of the said second swivel part and wherein the said first swivel part comprises an opening, the said opening being positioned such as to allow a flow of fluid to push the said locking sleeve upon an increase of internal pressure in the said bore.

The invention is equally related to a downhole swivel sub destined to be included between two sections of a workstring, said swivel sub having a bore extending there through and comprising:

- a first swivel part provided with a connection for a first section of the workstring;
- a second swivel part provided with a connection for a second section of the workstring and rotatable relative to the said first swivel part;
- a locking sleeve rotationally coupled with the said first Swivel part and movable axially between a first locking position wherein the said first swivel part and the said second swivel part are rotationally coupled and a second unlocking position wherein the said first swivel part is able to rotate relative to the said second swivel part;
- characterized in that a section of the said first swivel part is inserted into a section of the said second swivel part, the said first swivel part comprising a shoulder and the said second swivel part comprising two abutments on either side of the said shoulder, or inversely, the said second swivel part comprising a shoulder and the said first swivel part comprising two abutments on either side of the said shoulder, a set of tensile bearings being provided between the said shoulder and a first abutment situated upwards the said shoulder, and a set of compression bearings being provided between the said shoulder and a second abutment situated downwards the said shoulder.

In a down hole swivel sub according to the previous paragraph, the said compression bearings or the said tensile bearings or both compression bearings and tensile bearings may be maintained on their respective abutments by a high preload compression spring and at least a secondary abutment facing a portion of the said shoulder may be located on the swivel part comprising the said first and second abutments at a distance from the said shoulder inferior to the width of one of the said bearings.

The invention is equally related to a method for operating a jar to release an object stuck into a wellbore, the said jar being located in a workstring downstream a swivel sub according to the invention, the said workstring being connected to the said stuck object, the said method comprising the steps of:

- Unlocking the said swivel sub;
- Rotating the section of the workstring upstream the said swivel sub;
- Providing a tensile force or a compressive force on the said workstring to fire the said jar.

The invention is further related to method for operating a vibration tool to release an object stuck into a wellbore, the said vibration tool being located in a workstring downstream a swivel sub according to the invention, the said workstring being connected to the said stuck object, the said method comprising the steps of:

- Unlocking the said swivel sub;
- Rotating the section of the workstring upstream the said swivel sub while operating the said vibration tool;
- Providing a tensile force of a compressive force on the said workstring.

The invention is further related to a method for running a liner or a screen or a whipstock or any downhole element that is not suitable to rotate in a wellbore, the method comprising the steps of:

- Providing a swivel sob according to the invention in a workstring upper the said liner or screen or whipstock or any downhole element that is not suitable to rotate in a wellbore;
- Rotating the workstring with the said swivel sub unlocked such that the section of the workstring upper the said swivel sub is allowed to rotate while the said liner or screen or whipstock or any downhole element that is not suitable to rotate in a wellbore remains stationary;
- Running the said liner or screen or whipstock or any downhole element that is not suitable to rotate in the wellbore with the said swivel sub unlocked while rotating the workstring;
- Locking the said swivel sub;
- Rotating the said workstring.

DETAILED DESCRIPTION OF THE INVENTION

In the present description, the terms "front", "down", "lower", "downstream" and "moving down" relative to the downhole assembly of the present invention and its components means "facing or moving in a direction away from an entry opening of the wellbore at the surface. The terms "tail", "upstream", "moving up", "upper" and "up" relative to the downhole assembly of the present invention and its components means "facing towards or moving in a direction towards the entry opening of the wellbore". The term "workstring" means a string made of plurality of pipes connected to each other in order to run a downhole tool into a wellbore for drilling, for fishing or for doing any operation in the steps of the construction and operation of a wellbore.

According to a first aspect, the present invention relates to a swivel sub 100 suitable for connection in a workstring between an upper section hung out from the wellbore's surface and a bottom section in order to mitigate the drag by allowing the upper section of the workstring to rotate, the bottom section including a downhole element such as a jar, a vibration tool, a bottom hole assembly, a liner, a screen, a whipstock, a multilateral completion or any device which is not desirable or not possible to rotate into a wellbore.

Figure 1:
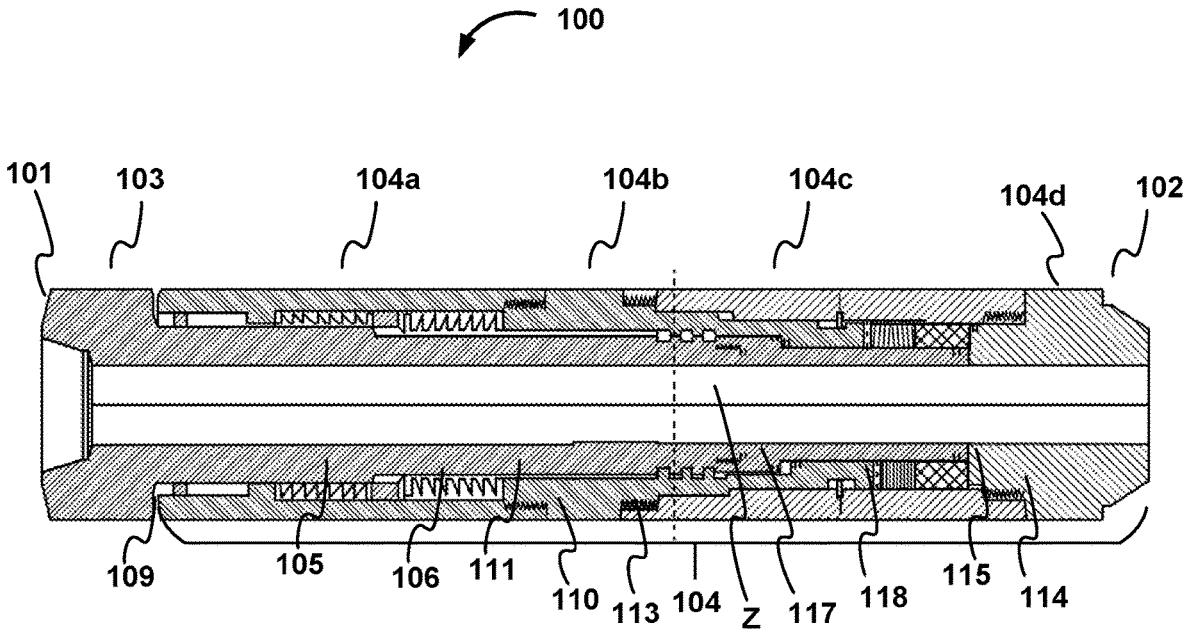
FIG. 1 presents a longitudinal cross section of a swivel sub according to an embodiment of the present invention.

The FIG. 1 shows a swivel sub 100 according to a preferred embodiment of the present invention comprising:

- a first swivel part comprising or consisting of a mandrel 103 provided with a first connecting end 101 and;
- a second swivel part surrounding partially the mandrel 103 (i.e. the mandrel being partially inserted in the second swivel part) and comprising or consisting of a housing assembly 104 provided with a second connecting end 102 opposite to the first connecting end 101.

The housing assembly 104 comprises:

- a first housing part 104*a* comprising a top end 109 and a bottom end 110;
- a second housing part 104*b* comprising:
  - a top end 111 connected to the bottom end 110 of the first housing part 104*a*, and
  - a bottom end 112;
- a third housing part 104*c* comprising:
  - a top end 113 connected to the bottom end 112 of the second housing part 104*b*, and;
  - a bottom end 114;
- a fourth housing part 104*d* comprising:
  - a top end 115 connected to the bottom end 114 of the third housing part 104*c*, and;
  - the said second connecting end 102.

Figure 2:
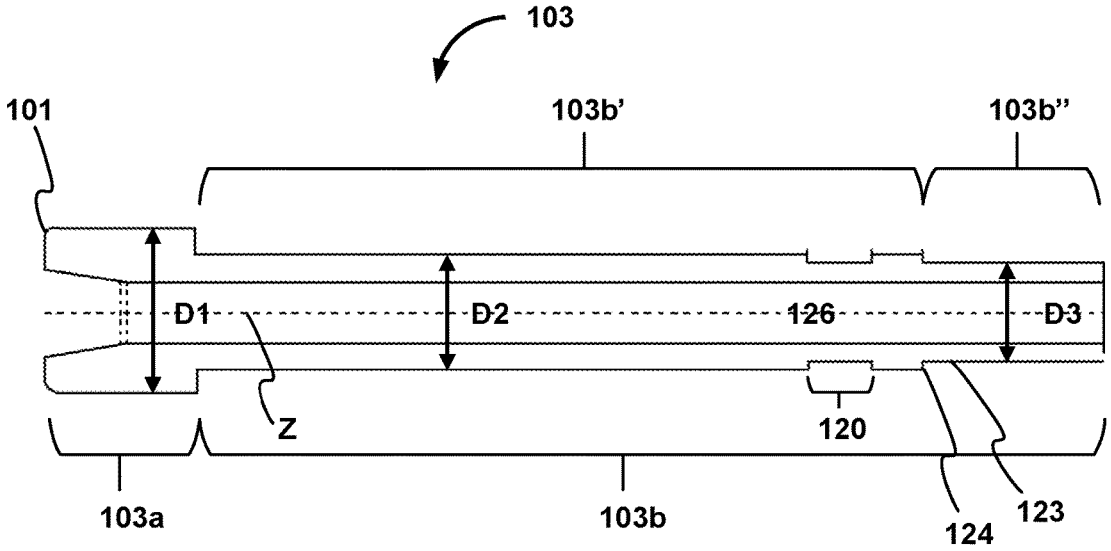
FIG. 2 shows a longitudinal cross section of a mandrel comprised in the swivel sub according to the embodiment of FIG. 1.

The mandrel 103 extends from the top end 109 of the first housing part through the housing assembly 104 until a section of the fourth housing part 104*d*. The mandrel 103 comprises a bore 126 extending there through. The FIG. 2 shows a view of the mandrel 103 according to a longitudinal cross section. The mandrel 103 comprises:

- a first mandrel part 103*a* of larger external diameter D1 substantially equal to the external diameter of the housing assembly 104, the first mandrel part 103*a* being outside of the housing assembly 104 and in line with the top end 109 of the housing assembly 104;
- a second mandrel part 103*b* of reduced external diameter relative to the first mandrel part and crossing the first housing part 104*a*, the second housing part 104*b*, and the third housing part 104*c*, and a portion of the fourth housing part 104*d;*

The second mandrel part 103*b* comprises:

- a first section 103*b*' adjacent to the first mandrel part 103*a*, having a first external diameter D2, and crossing the first housing part 104*a*, the second housing part 104*b* and a portion of the third housing part 104*c;*
- a second section 103*b*" adjacent to the first section 103*b*', having a second external diameter D3 inferior to the external diameter D2 of the first section 103*b';*

The first section 103*b*' of the second mandrel part 103*b* forms a shoulder 124 with the second section 103*b*" of the second mandrel part 103*b*. An opening 123 is located next to the shoulder 124 on the outermost surface of the second section 103*b*" of the second mandrel part and extends from the external surface of the second section 103*b*" to the bore 126 of the mandrel 103.

The first section 103*b*' of the second mandrel part 103*b* further comprises a coupling subsection 120 arranged inside the third housing part 104*c* and having a coupling means, for example a set of teeth, but preferably a polygonal cross section.

Figure 3:
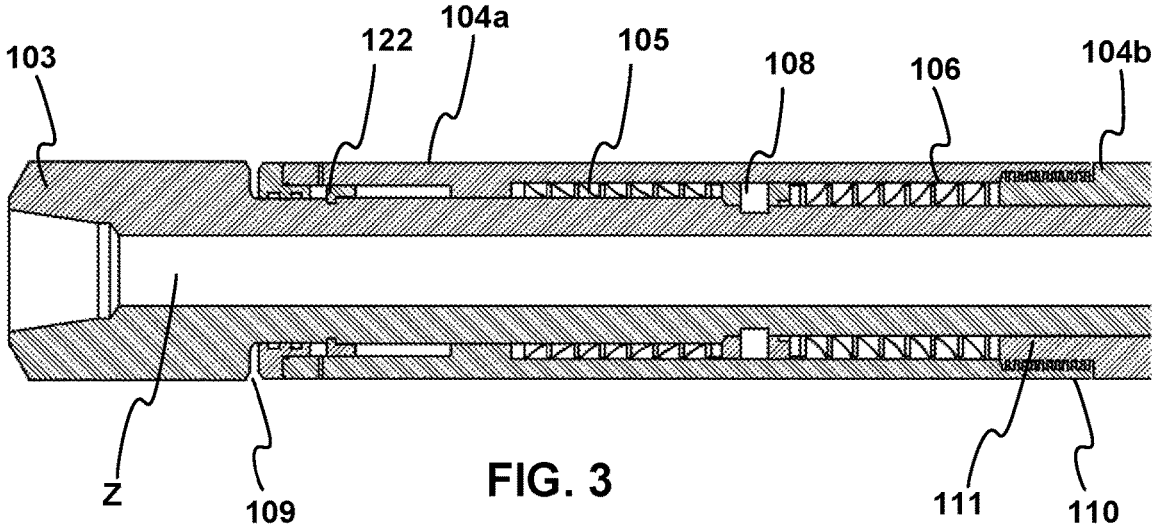
FIG. 3 shows an enlarged view of a longitudinal cross section of an upper section of the swivel assembly according to the embodiment of FIG. 1, including a portion of the mandrel, a first housing part of the housing assembly and a portion of a second housing part of the housing assembly.

The FIG. 3 shows an enlarged view of the first housing part 104*a* and the upper part of the mandrel 103. The inner wall of the first housing part 104*a* comprises a first shoulder 107 and the outer surface of the first section 103*b*' of the second mandrel part 103*b* comprises a second shoulder 108, for example a collar fastened around the mandrel, arranged downwards relative to the first shoulder 107 and inside the first housing part 104*a*. A set of tensile bearings 105 is arranged between the first shoulder 107 and the second shoulder 108.

The bottom end 110 of the first housing part 104*a* is a female end in which is screwed the top end 111 of the second housing part 104*b*. The top end of the second housing part is configured to form a ledge 111 into the first housing part 104*a*. A set of compression bearings 106 is arranged between the second shoulder 108 and the ledge 111 of the second housing part 104*b*.

The terms 'tensile bearing' and 'compression bearing' are to be understood as follows: both bearings are thrust bearings supporting an axial load. A compression bearing is in compression when the entire tool is in compression and a tension bearing is in compression when the entire tool is in tension.

Figure 7:
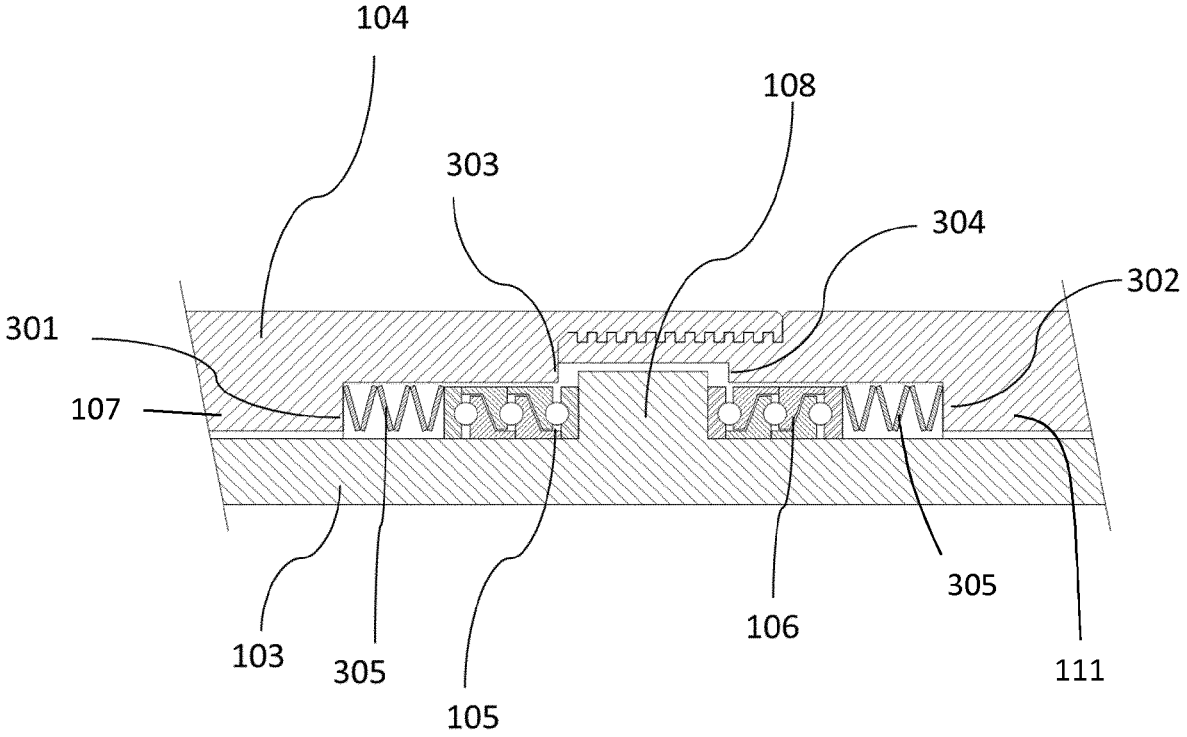
FIG. 7 shows an embodiment of the bearing arrangement between the first swivel part and the second swivel part.

Preferably, as presented in FIG. 7, the said compression bearings 106 or the said tensile bearings 105 or both compression bearings and tensile bearings are maintained on their respective abutments 302, 301 formed by the first shoulder 107 and the ledge 111 respectively by a high preload compression spring 305. At least one secondary abutment 303, 304 facing a portion of the said second shoulder 108 is located on the swivel part 104 comprising the said first and second abutments 301, 302, said secondary abutment(s) 303,304 being located at a distance from the said second shoulder 108 inferior to the width of one of the said bearings. Such feature is beneficial while the swivel sub is used in a method for operating a jar or a vibration tool wherein the bearings are subject to high shocks. This feature prevents extreme shocks on the bearing when the jar fires, the greater load would then compress the springs, but before the springs bottom out, there are an abutment 303/304 and a shoulder 108 coming into contact preventing the extreme shock load from passing through the bearings.

In an alternative to the embodiment of FIG. 3, the second shoulder 108 could be integral with the housing 104 instead of with the mandrel 103, in which case the first and second abutment 301,302 are situated on the mandrel 103 and not on the housing 104. In the analogue alternative to the embodiment of FIG. 7, the secondary abutments 303,304 could be situated on the mandrel 103 instead of on the housing 104.

Optionally, a pressure compensating piston 122 is provided around the mandrel 103, inside the first housing part 104*a*, between the top end 109 of the first housing part and the shoulder 107 of the first housing part such as to form a pressurized chamber. In that case, the space between the first section 103*b*' of the second mandrel part 103*b* and the housing assembly is filled with a lubricant, facilitating the rotation and the movement of the pieces inside the housing assembly.

Figure 4:
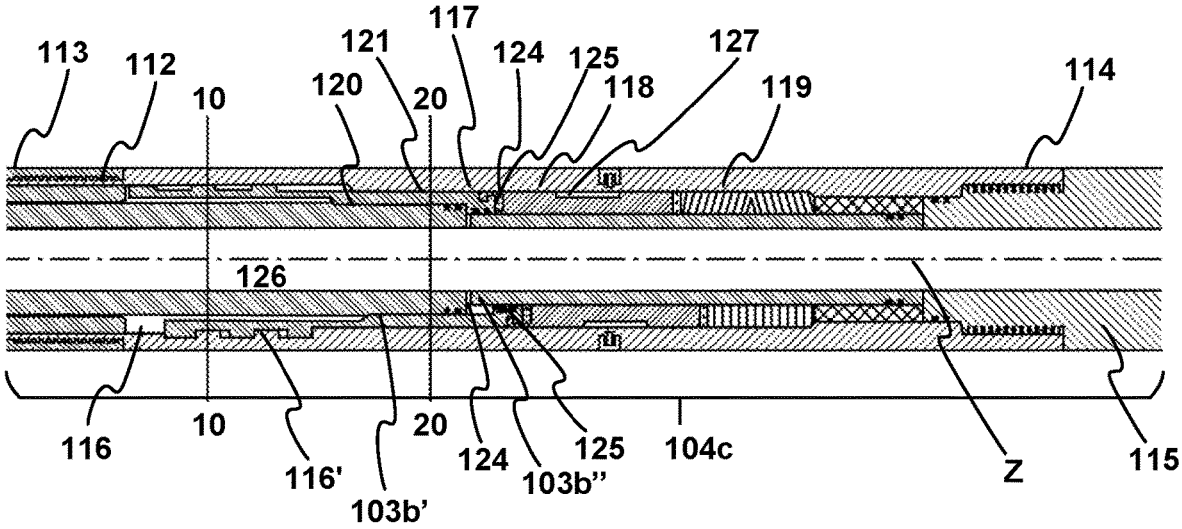
FIG. 4 shows an enlarged view of a longitudinal cross section of a third housing part of the housing assembly according to the embodiment of the FIG. 1.

The FIG. 4 shows an enlarged view of the third housing part 104*c* according to a longitudinal cross section. The top end 113 and the bottom end 114 of the third housing part 104*c* are provided by female thread sections which are screwed respectively to the male bottom section 112 of the second housing part 104*b* and to the male top section 115 of the fourth housing part 104*d*. The inner diameter of the third housing part 104*c* relative to the external diameter of the second mandrel part 103*b* is set up such that a space is available between the mandrel 103 and the third housing part 104*c* for a locking sleeve 117, a J-slot index mechanism 118 and a spring 119.

The inner wall of the third housing part 104*c* comprises a first section provided with a set of teeth 116 which are offset from the coupling subsection 120 of the mandrel 103. A locking sleeve 117 is arranged inside the third housing part 104*c* and around the mandrel 103. The locking sleeve 117 comprises:

- a first section wherein the outer surface of the locking sleeve 117 is provided with a set of teeth 116' which are arranged to mate with the set of teeth 116 of the inner surface of the third housing part 104*c* when the locking sleeve 117 is in a locking position and to disengage from the set of teeth 116 of the inner surface of the third housing part 104*c* when the locking sleeve is in a unlocking position;
- a second section wherein the inner surface of the locking sleeve 117 comprises an internal coupling subsection 121, preferably a polygonal coupling subsection arranged to match with the external coupling subsection 120 of the mandrel, such that the torque upon rotation of the mandrel 103 is transmitted to the locking sleeve 117; the coupling subsection 121 of the locking sleeve 117 is preferably shorter than the coupling subsection 120 of the mandrel. The locking sleeve 117 is able to move axially along the said external coupling subsection 120 of the mandrel.
- a third section wherein the inner surface of the locking sleeve 117 comprises a shoulder 125.

Figure 5:
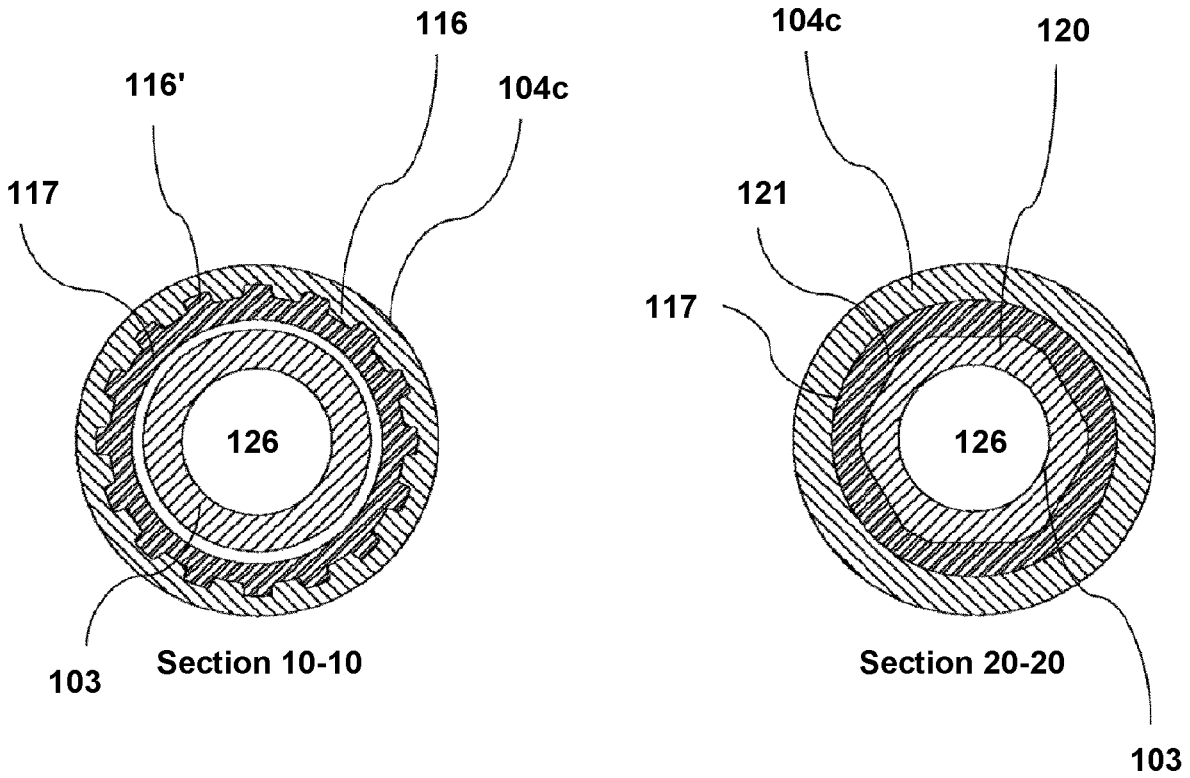
FIG. 5 section 10-10 shows a transversal cross sectional view of a section of the swivel sub comprising a set of matching teeth, and section 20-20 shows a transversal cross sectional view of a section of the swivel sub comprising a polygon coupling means.

FIG. 5 Section 10-10 shows a transversal cross section view of the swivel sub 100 at the arrow 10-10 of FIG. 4, wherein the teeth 116' of the locking sleeve 117 are engaged with the teeth 116 of the third housing part 104*c*.

FIG. 5 Section 20-20 shows a transversal cross section view of the swivel sub 100 at the arrow 20-20 of FIG. 4, wherein the polygonal coupling subsection 120 of the mandrel 103 is coupled with the polygonal coupling section 121 of the locking sleeve.

In a preferred embodiment of the invention, the set of teeth 116 of the inner surface of the third housing part 104*c* comprises a plurality of rows of teeth, the teeth of each row being distributed radially inside the third housing part 104*c*. The plurality of rows are aligned axially (i.e. corresponding teeth of all the rows are at the same radial position) and separated from each other in the axial direction by a distance slightly superior to the length of the teeth 116' of the locking sleeve. The set of teeth 116' of the locking sleeve comprises a plurality of rows of teeth, the teeth of each row being distributed radially about the external surface of the locking sleeve 117. The plurality of rows are aligned axially (i.e. corresponding teeth of all the rows are at the same radial position) and separated from each other in the axial direction by a distance slightly superior to the length of the teeth 116 of the third housing part 104*a*. By the term "distance slightly superior to the length" is understood "distance superior to maximum 10% of the length". Preferably, the length of the teeth 116 of the third housing part 104*c* are substantially the same than the length of the teeth 116' of the locking sleeve 117. Preferably, the distances separating each row of teeth 116 of the third housing part 104*c* are substantially the same as the distances separating each row of teeth 116' of the locking sleeve 117. Such an arrangement of teeth 116, 116' allows transmission of an elevated torque from the mandrel 103 to the housing assembly 104, when the locking sleeve is in the locking position. In other words, the transmission of torque from the first swivel part 103 to the second swivel part 104 is distributed across a section which is long enough for reducing the fatigue on the locking sleeve, on the mandrel and on the housing. Besides that, it requires only a small displacement of the locking sleeve 117 over a distance which is equal to the length of a spline formed by two rows of corresponding teeth 116/116', for locking the first swivel part 103 to the second swivel part 104 and for unlocking the first swivel part from the second swivel part. Such feature reduces the size of the cavity wherein the locking sleeve slides between the mandrel 103 and the housing 104, and thereby increases the robustness of the swivel tool.

The FIGS. 1 and 4 present a cross sectional view of the swivel sub along a longitudinal axis Z, wherein the section of the swivel sub above the Z axis is represented in the locking position and the section of the swivel sub under the Z axis is represented in the unlocking position. In the representation of the swivel sub in the FIGS. 1 and 4 above the Z axis, the locking sleeve 117 is maintained by a spring 119, preferably by a set of Belleville springs 119 in a locking position locking the rotation of the mandrel 103 with the housing assembly 104. The locking sleeve 117 is movable to the unlocking position as represented in the FIGS. 1 and 4 under the longitudinal axis Z, wherein the rotation of the mandrel 103 is unlocked from the housing assembly 104, which allows free rotation of the mandrel 103 relative to the housing assembly 104.

The locking sleeve 117 is dimensioned so as to tightly contact the first section 103*b*' and the second section 103*b*" of the second mandrel part 103 and such that:

- when the locking sleeve 117 is in its first position, the shoulder 125 of the locking sleeve 117 contacts the shoulder 124 formed by the first section 103*b*' and the second section 103*b*" of the second mandrel part 103*b* and;
- when the locking sleeve is in its second position, the shoulder 125 of the locking sleeve 117 is spaced from the shoulder 124 formed by the first section 103*b*' and the second section 103*b*" of the second mandrel part 103*b*.

The opening 123 on the mandrel next to the shoulder 124 formed by the first section 103*b*' and the second section 103*b*" of the second mandrel part 103*b*' allows the passage of a fluid that pushes down the locking sleeve 117 upon an increase of pressure into the bore 126 of the mandrel.

Advantageously, the locking sleeve 117 lies on a J-slot index sleeve 118 lying on the spring 119 or on the set of Belleville springs 119. The third housing part 104*c* further comprises a pin 127 guiding the J-slot index sleeve 118. The top end 115 of the fourth housing part 104*d* is screwed in the female bottom end 114 of the third housing part 104*c* and forms a ledge 115 in the third housing part 104*c*, on which ledge 115 lies the spring or the set of Belleville springs.

According to an embodiment, the swivel sub 100 of the invention is provided with the compression bearing 106 and tensile bearing 105 as described above, but wherein the coupling between the mandrel and the locking sleeve is configured in a manner that is known per se in the art, such as by a classic spline-type coupling. Preferably in the latter embodiment, the additional shoulders 303,304 are provided with respect to the shoulder 108, in the manner as described above.

The invention is equally related to a swivel sub as described in any of the embodiments described above, but wherein the locking sleeve 117 is rotationally coupled to the housing 104 instead of to the mandrel. In that case, the teeth 116 are located on an outer surface of the mandrel, while the teeth 116 are on an inner surface of the locking sleeve 117. All other details described in relation to the embodiments shown in the drawings are applicable mutatis mutandis.

Figure 6A:
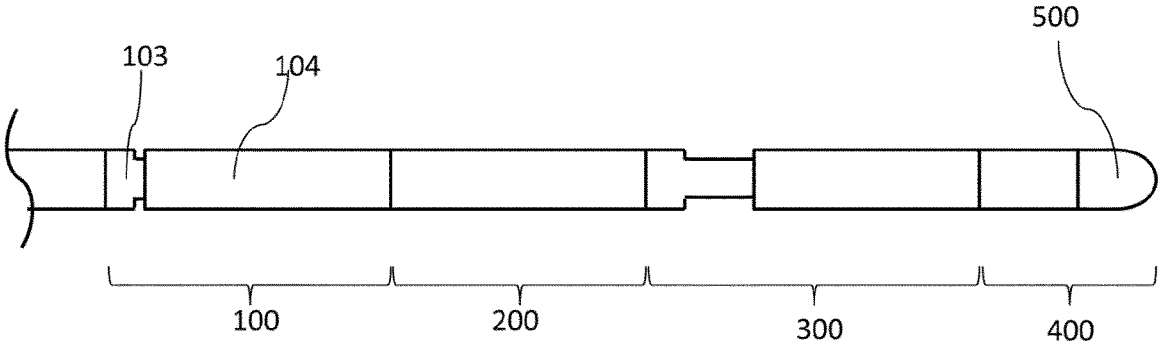
FIG. 6*a* shows a first embodiment of an arrangement of a workstring section including a swivel sub according to the present invention, a dart (or ball) catcher assembly, a jar and a bottom hole assembly.

FIG. 6*a* presents an arrangement of a workstring section including subsequently a swivel sub 100 according to the present invention, a dart (or ball) catcher sub 200, a jar 300 and a bottom hole assembly 400 comprising preferably a drilling tool 500.

Figure 6B:
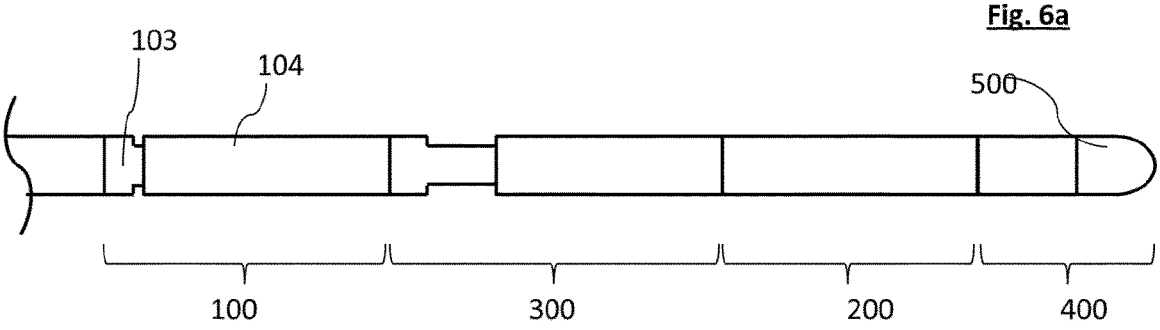
FIG. 6*b* shows a second embodiment of an arrangement of a workstring section including a swivel sub according to the present invention, a jar, a dart (or ball) catcher assembly and a bottom hole assembly.

FIG. 6*b* shows a second embodiment of an arrangement of a workstring section including subsequently a swivel sub 100 according to the present invention, a jar 300, a dart (or ball) catcher sub 200 and a bottom hole assembly (BHA) 400 comprising preferably a drilling tool 500.

The dart (or ball) catcher sub 200 is a separate sub located downstream to the swivel sub 100. The dart/ball catcher sub 200 comprises a bore extending there through and in which is provided a dart/ball catcher assembly that catches a dropped dart. Such devices are common in the art. When the dart is caught by the dart catcher assembly, it causes a pressure differential across the dart, which causes an increase of the pressure of the drilling fluid flowing through the work string and allows the drilling fluid to flow through the opening 123 for pushing down the locking sleeve 117 and the J-slot indexing sleeve 118 towards the unlocking position decoupling the set of teeth 116' of the locking sleeve from the set of teeth 116 of the third housing part 104*c*. Since the J-slot indexing sleeve 118 is retained by the pin 127 in a position compressing the spring or the set of Belleville springs 119, the pressure flow of the drilling fluid can be reduced while the locking sleeve is kept in its unlocking position allowing the mandrel 103 to be rotated with respect to the housing assembly 104. The upper part of the drill string connected to the mandrel 103 of the swivel sub is rotated relative to the housing assembly 104 and the lower part of the drill string connected to the housing assembly 104. Rotation of the upper part of the drill string reduces the drag between the upper part of the drill string and the walls of the wellbore, and allows more force to be transmitted to the Bottom Hole Assembly (BHA) which could free a stuck BHA 400 or facilitate the functioning of drilling jars 300 either up or down.

The swivel sub 100 can be relocked when the BHA is freed, providing full string integrity back to the BHA to continue drilling operations. Relocking of the swivel sub can be performed by increasing once again the pressure of the drilling fluid for allowing to the drilling fluid to flow through the opening 123 for pushing down the locking sleeve 117 and the J-slot indexing sleeve 118 such that the J-Slot indexing sleeve compresses the spring or the Belleville springs. Then the fluid pressure is decreased for releasing the pressure on the spring or the Belleville springs which release its energy on the J-slot indexing sleeve pushing the locking sleeve back in its locking position.

Further, if when pulling out of the hole (POOH) with a freed BHA, some part of the drillstring again becomes stuck, the swivel sub 100 can be unlocked again and rotated or back reamed through any obstruction.

The swivel sub 100 according to the present invention allows to aid the operation of drilling jars in Horizontal and ERD wells, by allowing free rotation of the drillstring, independent of the BHA, thus reducing friction and allowing the operator to get more tensile and compressive force to activate the jar.

The swivel sub 100 is simple to operate with a series of pump dropped darts that get caught in a dart catcher assembly provided in a dart catcher sub 200 downstream the swivel sub 100.

In the tool according to the invention, it is presumed to use a dart and a dart catcher, however that device is below the tool and somewhat independent from the mechanism. So we can use a ball, a dart, or simply pressure against the formation if flow is inhibited. Further, the dart envisaged is similar to a multi-dart system whereby the dart has an integral rupture disk. Once dropped, an over pressure causes the disk to rupture, thus allowing flow. Then another dart can be dropped, which seats into the previous dart.

Not shown is the dart catcher or other ball catching device, which is located immediately below the tool. Also not shown is the jarring mechanism—most likely somewhere below the tool.

Alternative means for moving the locking sleeve can be envisaged such as a telemetry system or an electronic package.

The swivel sub 100 is a multi-cycle tool that will allow the operator to continue drilling ahead after freeing the stuck BHA with no reduction in the drilling capabilities or swivel sub specification after re-locking.

The swivel sub 100 can also be used to run heavy long liners, screens and other open-hole completions.

The swivel sub 100 can be used to mitigate drag and provide additional force when used on high angle fishing operations.

The swivel sub 100 allows the drillstring to continue to be rotated when a BHA becomes stuck, maintaining suspension of cuttings, reducing the risk of the drillstring from becoming stuck in addition to the BHA.

The use of the swivel sub according to the present invention in a drillstring reduces the recover cost of a stuck in hole incident.

Some other advantages of the present invention are listed here below:

- It provides a jar enhancement tool allowing jars to be used more effectively in ERD drilling applications
- It recovers stuck BHA by reducing drag and allowing more force to be transmitted to the drilling jars
- The swivel sub of the present invention can also be used to run heavy long liners, screens and other equipment beyond the capabilities of the current swivel subs.
- The swivel sub of the present invention can be used to mitigate drag and provide additional force when used on high angle fishing operations.
- It assists in reducing buckling when applying a down force in ERD wells.
- It provides a high load down hole swivel that can be used to deploy screens and liners, and other open hole completions in horizontal and ERD wells.
- It can be used for side track operations to deploy Whip with rotation and lock out for orientation and milling operations
- It allows the drill string to continue to be rotated when a BHA becomes stuck, maintaining suspension of cuttings, reducing the risk of the drill string from becoming stuck in addition to the BHA.

It can be used to rotate the workstring while running in hole to prevent rotation of BHA while running through casing It provides for many hours of drill string rotation, allowing for adequate jarring time in an attempt to free the stuck BHA.

It allows the drill string to be rotated at high speed higher than the BHA can safely be rotated which enhances hole cleaning operations prior to or during POOH or while drilling ahead.

Can be run with a Circulating tool to enhance hole cleaning operations

Reduces the recover cost of a stuck in hole incident.

It provides a low risk addition to the drill string that will provide a reduction in time and cost to recover from a stuck BHA incident.

It provides a tool to aid the operation of drilling jars in Horizontal and ERD wells, by allowing free rotation of the drill string, independent of the BHA, thus reducing friction and allowing the operator to get more tensile and compressive force to activate the jar.

It is a Multi cycle tool that will allow the operator to continue drilling ahead after freeing the stuck BHA with no reduction in the drilling capabilities or DSM tool specification after re-locking.

Allows more load to be provided down hole when the work string cannot normally be rotated due to a stuck down hole BHA or inability to turn tools beyond a depth due to limitations of equipment or torque.

Allows drilling to continue after freeing the BHA by locking the swivel.

Increases probability of freeing a stuck BHA in an ERD well

Allows the ERD envelope to be pushed further

Reduces cost of recovery from a stuck BHA incident

Allows Jars to be operated if BHA is stuck in an ERD environment

Saves time and money

LIST OF REFERENCE NUMBERS

100 swivel sub
101 connection of first swivel part/first connecting end of the mandrel 103
102 connection of second swivel part
103 mandrel
103*a* first mandrel part
103*b* second mandrel part
103*b*' first section of second mandrel part 103*b*
103*b*" second section of second mandrel part 103*b*
104 housing assembly
104*a* first housing part
104*b* second housing part
104*c* third housing part
104*d* fourth housing part
105 tension bearings
106 compression bearings
107 first shoulder inside the first housing part 104*a*
108 second shoulder at the outer surface of the mandrel 103
109 top end of first housing part 104*a*
110 second end of first housing part 104*a*
111 top end of second housing part 104*b*
112 bottom end of second housing part 104*b*
113 top end of the third housing part 104*c*
114 bottom end of the third housing part 104*c*
115 top end of the fourth housing part 104*d*
116 set of teeth of the housing
116 set of teeth of the locking sleeve to mate with the teeth of the housing
117 locking sleeve
118 J-slot index sleeve
119 spring
120 coupling subsection of the mandrel 103
121 coupling section of the locking sleeve to mate with the coupling section 120 of the mandrel 103
122 pressure compensating piston
123 opening in the second section 103*b*" of the second mandrel part 103*b*
124 shoulder on the outermost surface of the second section 103*b*"
125 shoulder of the locking sleeve
126 bore of the mandrel 103
127 pin for the J-slot
200 dart/ball catcher sub
300 jar
400 bottom hole assembly (BHA)
301 abutment for tensile bearings
302 abutment for compression bearings
303 secondary abutment
304 secondary abutment

The invention claimed is:

1. A downhole swivel sub comprising:

a first swivel part configured to connect to a first section of a workstring;

a second swivel part configured to connect to a second section of the workstring, wherein the second swivel part is rotatable relative to the first swivel part, and wherein the first swivel part and second swivel part are coaxial with respect to an axis; and a locking sleeve rotationally coupled with the first swivel part and movable axially between a locking position wherein the first swivel part and the second swivel part are rotationally coupled and an unlocking position wherein the first swivel part is rotatable relative to the second swivel part, wherein:

the locking sleeve comprises two first rows of teeth, each tooth of the two first rows of teeth is disposed at a same radial distance from the axis, each tooth of a first row in the two first rows of teeth shares an azimuthal position with at least one other tooth in another row of the two first rows of teeth, the two first rows of teeth are separated axially on the locking sleeve, and the two first rows of teeth are configured to engage with two second rows of teeth located on the second swivel part when the locking sleeve is in the locking position, and the first rows of teeth are configured to disengage from the second rows of teeth of the second swivel part when the locking sleeve is in the unlocking position.

2. The downhole swivel sub of claim 1, wherein the locking sleeve comprises a coupling subsection, and the first swivel part comprises a matching coupling subsection, wherein the locking sleeve is configured to move axially along the coupling subsection of the first swivel part.

3. The downhole swivel sub of claim 2, wherein the coupling subsection of the first swivel part is axially longer than the coupling subsection of the locking sleeve.

4. The downhole swivel sub of claim 2, wherein the coupling subsection of the locking sleeve and the coupling subsection of the first swivel part have matching polygonal cross-sections.

5. The downhole swivel sub of claim 1, wherein a section of the first swivel part is inserted into a section of the second swivel part.

6. The downhole swivel sub of claim 5, wherein the first rows of teeth of the locking sleeve are located on an external surface of the locking sleeve, and wherein the second rows of teeth of the second swivel part are located on an inner surface of the second swivel part.

7. The downhole swivel sub of claim 5, wherein the first swivel part comprises a shoulder and the second swivel part comprises first and second abutments on either side of the shoulder.

8. The downhole swivel sub of claim 7, comprising tensile bearings located between the shoulder and the first abutment, and compression bearings located between the shoulder and the second abutment.

9. The downhole swivel sub of claim 8, wherein the tensile bearings are biased between the shoulder and the first abutment by a first preload compression spring, and the compression bearings are biased between the shoulder and the second abutment by a second preload compression spring.

10. The downhole swivel sub of claim 1, wherein:
the first swivel part comprises a shoulder;
the second swivel part comprises:
a first abutment and a second abutment on either side of the shoulder; and
a first secondary abutment and a second secondary abutment, each secondary abutment facing the shoulder a distance from the shoulder that is less than a width of tensile bearings or a width of compression bearings;
the tensile bearings are located between the shoulder and the first abutment; and
the compression bearings are located between the shoulder and the second abutment.

11. The downhole swivel sub of claim 5, wherein the second swivel part comprises a shoulder and the first swivel part comprises first and second abutments on either side of the shoulder.

12. The downhole swivel sub of claim 11, comprising tensile bearings located between the shoulder and the first abutment, and compression bearings located between the shoulder and the second abutment.

13. The downhole swivel sub of claim 12, wherein the tensile bearings are biased between the shoulder and the first abutment by a first preload compression spring, and the compression bearings are biased between the shoulder and the second abutment by a second preload compression spring.

14. The downhole swivel sub of claim 1, wherein:
the second swivel part comprises a shoulder;
the first swivel part comprises:
a first abutment and a second abutment on either side of the shoulder; and
a first secondary abutment and a second secondary abutment, each secondary abutment facing the shoulder at a distance from the shoulder that is less than a width of tensile bearings or a width of compression bearings;
the tensile bearings located between the shoulder and the first abutment; and
the compression bearings located between the shoulder and the second abutment.

15. The downhole swivel sub of claim 5, wherein the first swivel part comprises an opening, wherein the opening is configured to allow a flow of fluid to apply a force against the locking sleeve upon an increase in internal pressure in a bore of the downhole swivel sub.

16. The downhole swivel sub of claim 1, wherein the first swivel part and the second swivel part form a chamber comprising the locking sleeve, wherein the chamber is sealed to the outside of the downhole swivel sub.

17. The downhole swivel sub of claim 1, wherein the locking sleeve lies on a J-slot index mechanism and a spring maintained by a shoulder inside the second swivel part.

18. The downhole swivel sub of claim 1, further comprising:
a shoulder of a first part, wherein the first part is one of the pair of swivel parts comprising the first swivel part or the second swivel part, and wherein a second part is the other of the pair of swivel parts;
a first abutment and a second abutment on either side of the shoulder, wherein a tensile bearing is located between the shoulder and the first abutment, and wherein a compression bearing is located between the shoulder and the second abutment, and wherein the second part comprises the first abutment and the second abutment;
a first secondary abutment and a second secondary abutment, wherein each respective secondary abutment of the first secondary abutment and the second secondary abutment faces the shoulder, and wherein the respective secondary abutment is a respective distance from the shoulder that is less than a width of the tensile bearing or a width of the compression bearing, and wherein the second part comprises the first secondary abutment and the second secondary abutment.

19. A method comprising:
unlocking a downhole swivel sub, the downhole swivel sub comprising:
a first swivel part configured to connect to a first section of a workstring;
a second swivel part configured to connect to a second section of the workstring, wherein the second swivel part is rotatable relative to the first swivel part, and wherein the first swivel part and second swivel part are coaxial with respect to an axis; and
a locking sleeve rotationally coupled with the first swivel part and movable axially between a locking position wherein the first swivel part and the second swivel part are rotationally coupled and an unlocking position wherein the first swivel part is rotatable relative to the second swivel part, wherein:
the locking sleeve comprises two first rows of teeth,
each tooth of the two first rows of teeth is disposed at a same radial distance from the axis,
each tooth of a first row in the two first rows of teeth shares an azimuthal position with at least one other tooth in another row of the two first rows of teeth,
the two first rows of teeth are separated axially on the locking sleeve,
and the two first rows of teeth are configured to engage with two second rows of teeth located on the second swivel part when the locking sleeve is in the locking position, and the first rows of teeth are configured to disengage from the second rows of teeth of the second swivel part when the locking sleeve is in the unlocking position;

rotating a section of a workstring upstream the downhole swivel sub; and providing a tensile force or a compressive force on the workstring to fire a downhole element.

* * * * *